US010001337B2

(12) United States Patent
Curliss

(10) Patent No.: US 10,001,337 B2
(45) Date of Patent: Jun. 19, 2018

(54) COMPOSITE MULTI-LOBE PROJECTILE BARREL

(71) Applicant: Proof Research, Inc., Columbia Falls, MT (US)

(72) Inventor: David Brian Curliss, Beavercreek, OH (US)

( * ) Notice: Subject to any disclaimer, the term of this patent is extended or adjusted under 35 U.S.C. 154(b) by 0 days. days.

(21) Appl. No.: 15/407,914

(22) Filed: Jan. 17, 2017

(65) Prior Publication Data

US 2017/0205172 A1 Jul. 20, 2017

Related U.S. Application Data

(60) Provisional application No. 62/278,554, filed on Jan. 14, 2016.

(51) Int. Cl.

| | |
|---|---|
| ***F41A 21/00*** | (2006.01) |
| ***F41A 21/04*** | (2006.01) |
| ***F41A 21/20*** | (2006.01) |
| ***F41A 21/16*** | (2006.01) |

(52) U.S. Cl.

CPC ..... *F41A 21/04* (2013.01); *F41A 21/16* (2013.01); *F41A 21/20* (2013.01)

(58) Field of Classification Search

CPC ..... F41A 21/02; F41A 21/04; F41A 21/20; F41A 21/44

See application file for complete search history.

(56) References Cited

U.S. PATENT DOCUMENTS

| | | | | |
|---|---|---|---|---|
| 2,499,944 A * | 3/1950 | Brace | F41A 21/04 42/78 |
| 3,813,098 A * | 5/1974 | Fischer | F16L 9/08 138/141 |
| 4,007,574 A | 2/1977 | Riddell | |
| 4,485,721 A | 12/1984 | Shankhla et al. | |
| 4,582,758 A | 4/1986 | Bruce et al. | |

(Continued)

FOREIGN PATENT DOCUMENTS

GB 128365 A * 6/1919 ..... F41A 21/02

OTHER PUBLICATIONS

BCPR Black Powder Cartridge Rifle Barrels—Classic Tapered Octagon Rifle Barrels—4140 Steel—Green Mountain Rifle Barrel Co., http://www.gmriflebarrel.com/classic-tapered-octagon-rifle-barrels-4140-steel/, 3 pgs.

(Continued)

*Primary Examiner* — Gabriel J Klein

(74) *Attorney, Agent, or Firm* — Antoinette M. Tease

(57) ABSTRACT

A composite multi-lobe barrel is disclosed for directing the path of a dischargeable projectile. The multi-lobe barrel incorporates a plurality of longitudinal stiffening rods into a composite overwrap around an inner liner to enhance axial stiffness. The barrel is comprised of an inner liner defining an axial bore; a plurality of polymer matrix composite (PMC) stiffening rods equidistantly disposed around the inner liner and a PMC outer shell enclosing the stiffening rods. In one embodiment, a PMC inner wrap surrounds and is in direct contact with the inner liner, with the stiffening rods arranged equidistantly around the inner wrap, with this structure enclosed by a PMC outer shell.

2 Claims, 7 Drawing Sheets

(56) References Cited

U.S. PATENT DOCUMENTS

| | | | | |
|---|---|---|---|---|
| 4,646,615 | A * | 3/1987 | Gladstone | B29C 53/805 42/76.02 |
| 5,125,179 | A * | 6/1992 | Campbell | B29C 70/56 42/76.02 |
| 5,214,234 | A * | 5/1993 | Divecha | F41A 21/02 42/76.02 |
| 5,600,912 | A * | 2/1997 | Smith | F41A 21/02 42/76.01 |
| 6,189,431 | B1 * | 2/2001 | Danner | F41A 21/02 42/76.02 |
| 6,453,635 | B1 | 9/2002 | Turner | |
| 6,497,065 | B1 * | 12/2002 | Huston | F41A 21/02 42/76.02 |
| 6,562,436 | B2 | 5/2003 | George et al. | |
| 6,889,464 | B2 * | 5/2005 | Degerness | F41A 21/02 42/76.01 |
| 6,949,282 | B2 * | 9/2005 | Obeshaw | B21C 37/15 138/119 |
| 8,020,333 | B2 * | 9/2011 | Hall | F41A 21/02 42/76.01 |
| 9,823,034 | B2 * | 11/2017 | Johnson | F41A 21/36 |
| 2009/0068441 | A1 | 3/2009 | Swaroop et al. | |
| 2011/0173864 | A1 * | 7/2011 | Christensen | F41A 21/02 42/78 |
| 2017/0261280 | A1 * | 9/2017 | Glisovic | F41A 21/02 |

OTHER PUBLICATIONS

The Firearm Blog: Engineers' perspective on the Remington 700 VTR triangular barrel, http://www.thefirearmblog.com/blog/2009/02/22/engineers-perspective-on-the-remington-700-vtr-triangular-barrel/.

The Firearm Blog: Remington Model 700 VTR, http://www.thefirearmblog.com/blog/2008/01/04/remington-model-700-vtr/.

The Firing Line (Forum about Triangular Barrel), http://thefiringline.com/forums/showthread.php?t=377658&page=2.

US 155mm/62 Advanced Gun System (AGS), http://www.navweaps.com/Weapons/WNNUS_61-62_ags_pics.htm.

* cited by examiner

COMPOSITE MULTI-LOBE PROJECTILE BARREL

CROSS REFERENCE TO RELATED APPLICATIONS

This application claims priority to Provisional Patent Application No. 62/278,554, filed Jan. 14, 2016, the entire disclosure of which is hereby incorporated by reference and relied upon.

BACKGROUND OF THE INVENTION

The invention relates generally to barrels for directing the path of a dischargeable projectile, such as a firearm barrel or artillery barrel, and methods for forming same. More particularly, the invention relates to a composite gun barrel comprising a fiber reinforced polymer matrix composite incorporating longitudinal stiffening rods.

One attribute associated with high-performance in a gun barrel is stiffness. Higher stiffness increases the resonant frequency of the barrel and suppresses the amplitude of waves generated when a projectile, e.g. a bullet, travels down the bore, resulting in less muzzle displacement when the bullet exits and greater accuracy. Increased stiffness also reduces muzzle depression or droop when a weight, such as a suppressor, is attached to the barrel, resulting in reduced point of impact shift of the projectile. All else equal, a stiffer barrel is generally better for any caliber weapon, from small arms to large bore military cannons. Barrels intended for precision shooting conventionally achieve greater stiffness by increasing the diameter and mass of the barrel compared to barrels used for general purpose shooting/hunting. In many applications, however, less barrel mass is desired.

It is known to substitute relatively strong but lightweight materials—such as unreinforced and reinforced polymers, continuous glass fiber or carbon fiber composites—for various portions of the gun commonly fabricated from steel, aluminum, or other metals. Attention has focused on gun barrels, which constitute a large percentage of a gun's weight. It is known, for example, to fabricate a gun barrel having a steel inner liner surrounded by a carbon fiber reinforced polymer matrix composite (PMC) outer shell, incorporating a resin. This combination lightens the gun while retaining good barrel strength and stiffness.

The carbon fibers used in the PMC outer shell may be any type that provides the desired stiffness, strength and thermal conductivity. Typically for PMC gun barrel applications, polyacrylonitrile ("PAN") precursor or pitch precursor carbon fibers are used. The carbon fiber may be applied as dry carbon fiber strands or tows which are combined with a resin in a "wet" dip pan process, then wound around the inner liner. Alternatively, the shell may be built from carbon fiber tow, unidirectional tape, or fabric that was previously impregnated with resin in a separate process ("towpreg" or "prepreg"), then applied to the inner liner. Whether applied wet or dry, the matrix resin is typically an epoxy but may also be a polyimide or any other suitable resin. The composite barrel may then be cured, finished, and attached to a receiver with a trigger mechanism and a stock to produce a firearm.

Composite firearm barrels in the prior art are often significantly lighter than conventional steel barrels, but may not exhibit comparable stiffness. In some cases it is possible to manufacture a composite barrel with light weight and good stiffness, but at a higher cost or sacrifice to other performance attributes. What is needed is a composite barrel having improved stiffness.

BRIEF SUMMARY OF THE INVENTION

A composite multi-lobe barrel is disclosed for directing the path of a dischargeable projectile. The multi lobe barrel incorporates longitudinal (parallel to the axial bore) stiffening rods into a composite winding overwrap around an inner liner to enhance axial stiffness. The barrel is comprised of an inner liner defining an axial bore; a plurality of polymer matrix composite (PMC) stiffening rods equidistantly disposed around said inner liner and a PMC outer shell enclosing the stiffening rods. In one embodiment, a PMC inner wrap surrounds and is in direct contact with the inner liner, with the stiffening rods arranged equidistantly and circumferentially around the inner wrap, with this structure enclosed by a PMC outer shell. In another embodiment, the barrel is a tri-lobe barrel comprising three stiffening rods, each having a cross section approximately resembling a triangle, with the interior side (i.e. the side closest to the axial bore) of the triangular rod being concave to complement the curvature of the inner liner on which it is disposed.

It is to be understood that the invention may be practiced with many makes and models of projectile barrels with comparable effectiveness.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1A:
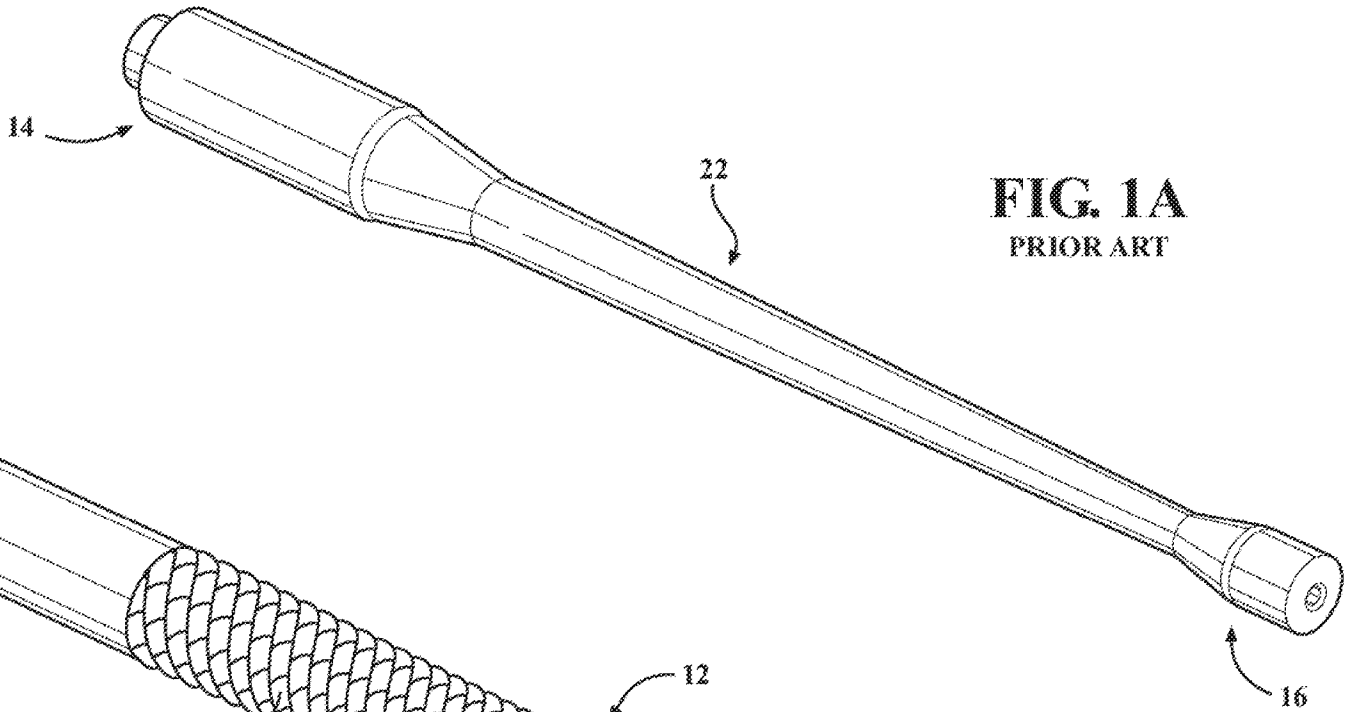
FIG. 1A PRIOR ART
FIG. 1A shows a prior art inner liner for a rifle.

Referring to the figures wherein like numerals indicate like or corresponding parts throughout the several views, FIG. 1A shows inner liner 22 having a breech end 14 and a muzzle end 16. Inner liner 22 is commonly made of metal and most frequently a steel alloy such as stainless steel. A metal inner liner, such as stainless steel, facilitates fabrication of rifling lands and grooves along axial bore 24 as well as threads at the muzzle and/or breech ends of the barrel. The inner liner may also be a nonmetallic material such as a ceramic, refractory alloy or material, or a polymer-based material. Between breech end 14 and muzzle end 16, inner liner 22 is cylindrical, though it need not be uniformly cylindrical. For example, inner liner 22 may radially expand at the breech end 14 to accommodate cutting of threads for insertion into a firearm's receiver and/or to sustain higher pressures upon ignition of gunpowder propellant. Inner liner 22 may also taper outwards at the muzzle 16, or include other configurations depending on desired features of the gun. Outer shell 36 likewise may include noncylindrical features (e.g. to accommodate a gas block for semiautomatic rifles) or be discontinuous over the length of multi lobe barrel 20. For purposes of this specification and the claims, inner liner 22 is "cylindrical" if inner liner 22 has a cylindrical appearance over most of its overall length.

Figure 1B:
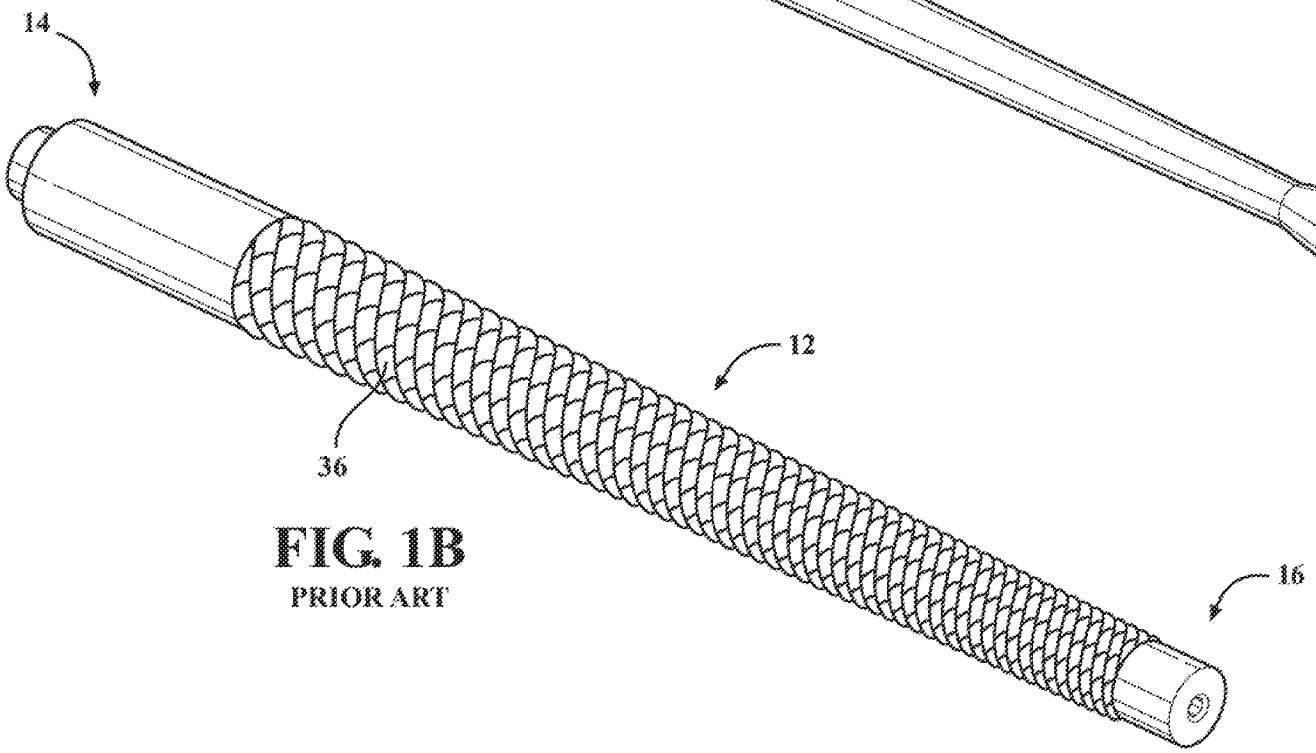
FIG. 1B PRIOR ART
FIG. 1B shows a prior art finished composite barrel with a PMC shell surrounding the inner liner.

FIG. 1B shows prior art composite barrel 12, where the inner liner 22 has been wrapped with a continuous fiber tow and a resin to form a continuous fiber composite (CFC) outer shell 36. The CFC can comprise tows, such as carbon fiber tows, or comprise a fabric of continuous fibers, and can be applied with the resin wet or dry such as with pre-impregnated fibers ("prepreg"). Outer shell 36 may be formed by wrapping a continuous carbon fiber tow (a collection of carbon fiber filaments) around inner liner 22 in layers until a sufficient radial depth is obtained. For example, outer shell 36 may be formed by helically wrapping a fiber tow at a constant winding angle or at a plurality of winding angles and winding layers around inner liner 22, creating radial regions of windings.

Figure 2:
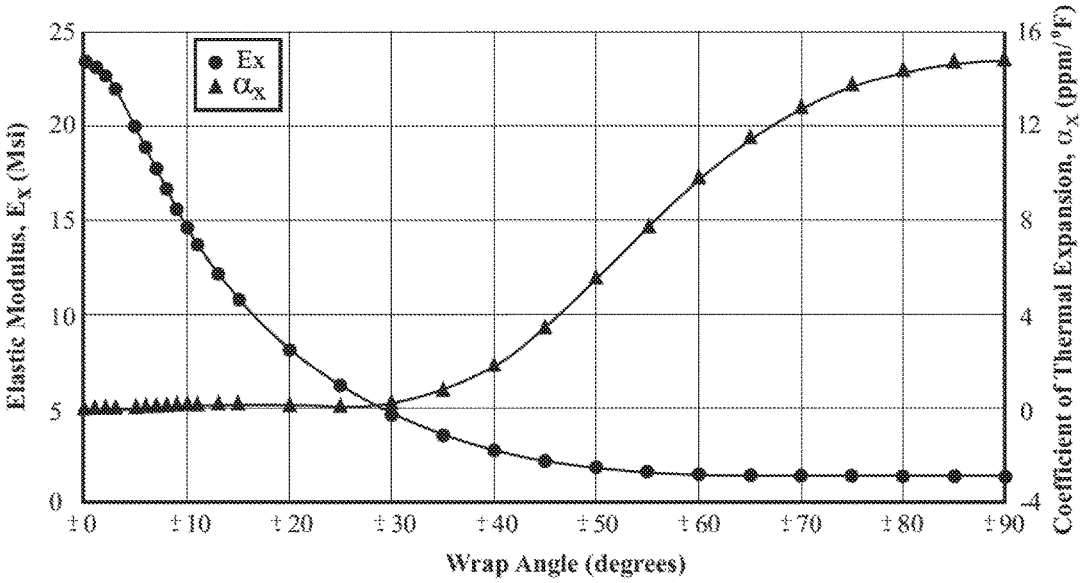
FIG. 2 is a chart showing the relationship between carbon fiber wrap angle, angle effect on axial stiffness of the continuous fiber composite, and angle effect on axial CTE.

The stiffness of the finished barrel will depend largely on the materials utilized, their dimensions, and on winding angles of the fiber. FIG. 2 shows the effect of winding angles on axial stiffness. The stiffness numbers are calculated under classical laminate theory assuming an intermediate modulus PAN carbon fiber at 60% fiber volume fraction in a polymer resin matrix composite. The first data on the chart shows the effect of wrap angle on the stiffness of the outer shell in the axial direction, measured as millions of pounds per square inch (Msi). At zero degrees relative to the barrel's axis (i.e., parallel to axial bore 24) the elastic modulus $E_x$ is nearly 24 Msi, which approaches type AISI 416 stainless steel (UNS S41600) which has $E_x$ of 29 Msi. Thus increasing the fraction of zero degree carbon fibers in the CFC will increase stiffness at a fraction of the weight of steel. Moreover, the greater the radial distance a given mass of longitudinal plies is located from axial bore 24 and inner liner 22, the greater its contribution to axial stiffness.

As the winding angle relative to the barrel's axis increases, stiffness drops sharply. At a winding angle of ±45°, $E_x$ falls to about 2.4 Msi. Although near-perpendicular "hoop" windings contribute greatly to burst strength, their contribution to axial stiffness is small, falling to under 2 Msi.

FIGS. 3-7 show a first embodiment of a finished multi-lobe barrel 20 according to the current invention. Inner liner 22 has an axial bore 24 and is exposed at breech end 14 and muzzle end 16. Otherwise, the exterior of multi-lobe barrel 20 is mainly its outer shell 36. Outer shell 36 is a polymer matrix composite (PMC) comprised of fibers and resin. As in the prior art, multi lobe barrel 20 may be assembled with a receiver, stock, trigger, and other familiar features to form a firearm. In operation, a cartridge of ammunition is inserted into the receiver. The cartridge has a base portion containing a gunpowder charge and dischargeable projectile, i.e., a bullet. When a shooter pulls the trigger, a firing pin strikes the base of the cartridge, igniting the gunpowder charge and causing the bullet to discharge through axial bore 24 and out of the muzzle end 16.

Figure 3:
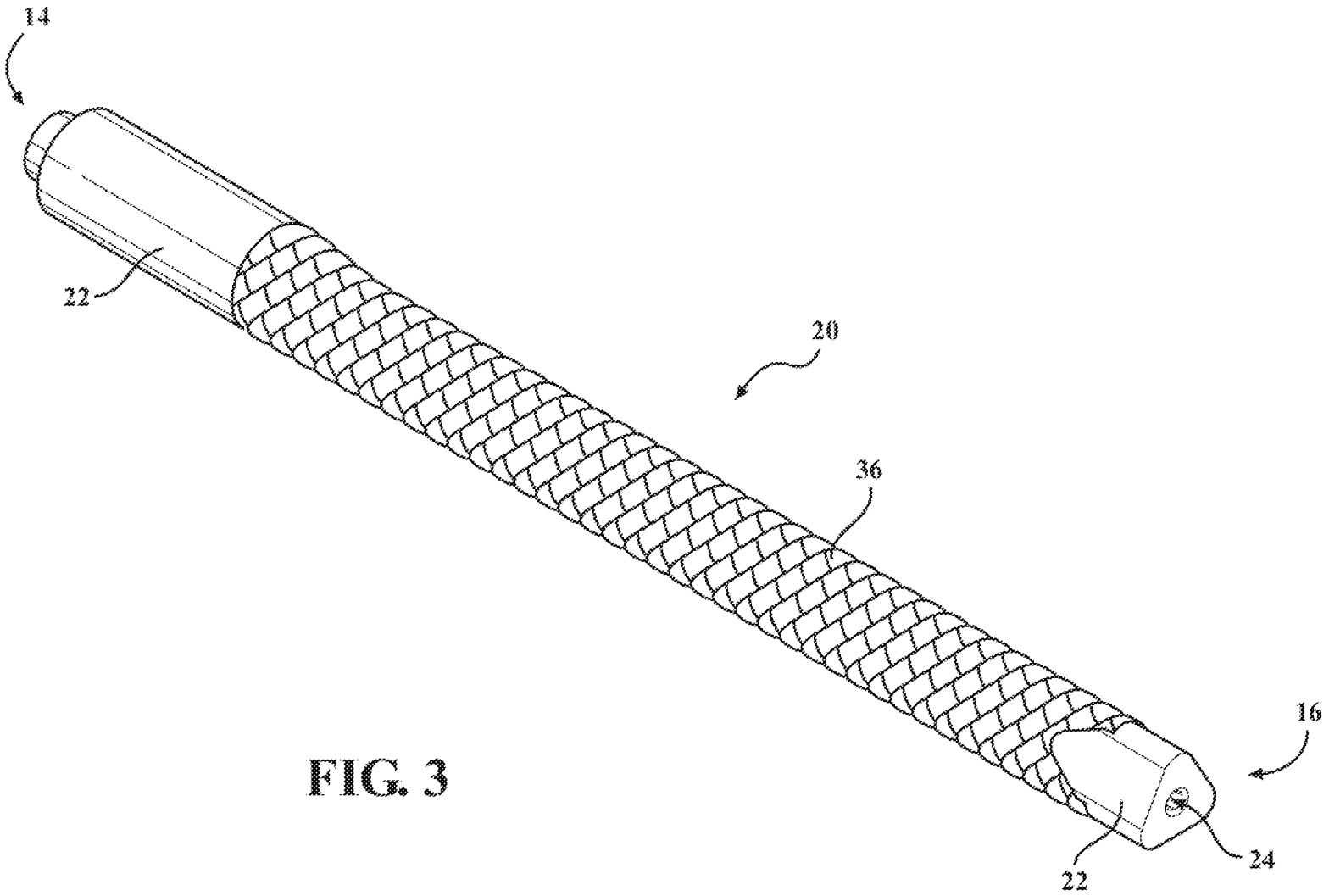
FIG. 3 is a perspective view of a finished composite multi-lobe barrel according to the invention.
Figure 4:
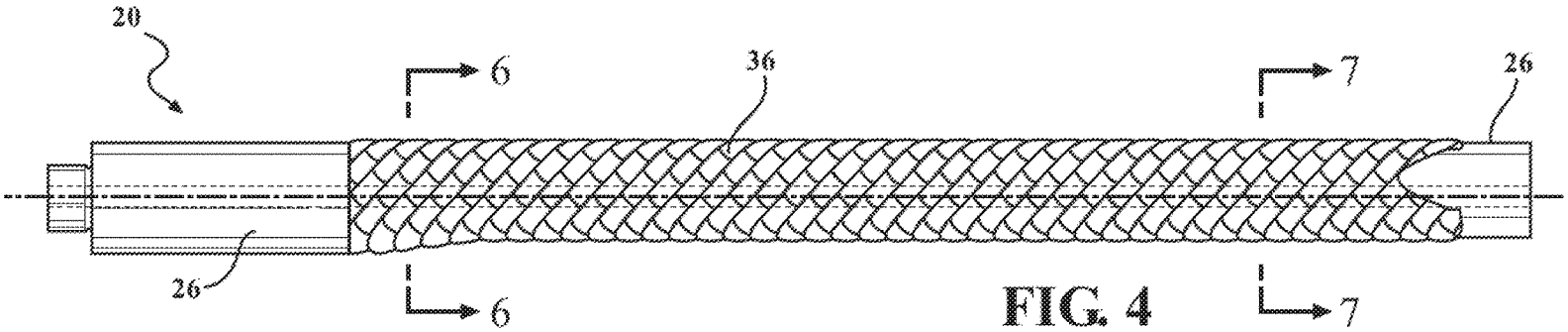
FIG. 4 is a side view of the composite barrel depicted in FIG. 3.
Figure 5:
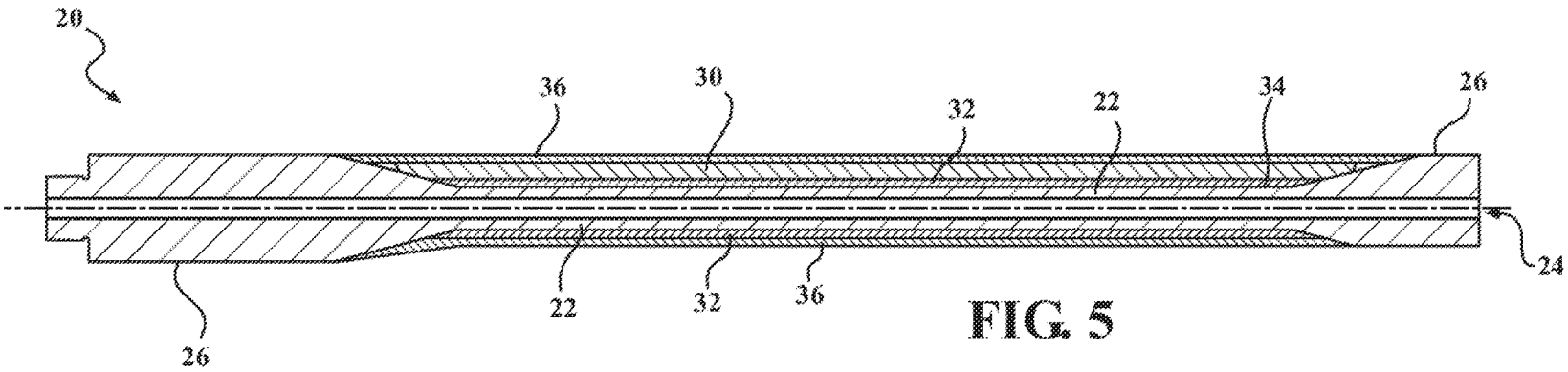
FIG. 5 is a longitudinal section of the composite barrel shown in FIG. 3.

FIGS. 3-7 show an embodiment where outer shell 36 is a PMC formed by wrapping a fiber tow around inner liner 22 in a helical fashion. As best shown in FIG. 5, the inner liner 22 has a saddle area between a breech end 14 and muzzle end 16 into which the reinforcement inserts 30 are located. In the illustrated examples, the saddle area has a smaller outer diameter than the outer diameters of inner liner 22 at its muzzle end 16 and breech end 14. As will be appreciated, in the embodiment shown, the exterior of multi-lobe barrel 20 resembles an elongated triangular prism, not an elongated cylinder. Thus the geometry of the fibers wrapped around the triangular prism are not strictly helical.

In the embodiment shown in FIGS. 3-7, multi-lobe barrel 20 comprises three sets of stiffening rods 30 arrayed circumferentially on inner composite wrap 32 in substantially equidistant orientation to align with the triangular prime shape of the muzzle end 16. The incorporation of stiffening rods 30 facilitates longitudinal stiffness of multi-lobe barrel 20 by increasing the percentage of 0° fibers comprising multi-lobe barrel 20. Stiffening rods 30 can be comprised of stiffer fibers having a higher modulus of elasticity than fibers comprising inner wrap 32 and outer shell 36 to increase longitudinal stiffness. The alignment of stiffening rods 30 may be accomplished by using tools and techniques known to those skilled in the art, including adhesives, clamps, bands, or a jig or a fixture. Alternatively, stiffening rods 30 may be applied shortly after winding inner wrap 32 while it is still hot and/or wet. In this embodiment, stiffening rods 30 may bond firmly to inner wrap 32 in an intermediate curing step eliminating the requirement of a jig or clamps during the wrapping process of outer shell 36.

In one embodiment, outer shell 36 comprises continuous fiber filament, or tow. In another embodiment (not shown) the fiber could be in the form of fabric or a weave. Carbon fibers are typically advantageous to use for PMC gun barrels due to their high stiffness, high strength, and low density. The term "carbon fiber" is used to generically describe carbon and graphite fibers irrespective of their manufacturing process or precursor materials, and specifically includes both PAN precursor and pitch precursor carbon fibers. In one embodiment, the tow is PAN carbon fiber filament tow, such as HexTow IM2A available from Hexcel Corporation, Stamford Conn. However, the tow could also be a pitch carbon fiber, such as GRANOC CN-60-A2S, available from Nippon Graphite Fiber Corporation, Tokyo, Japan, or any suitable fiber for manufacturing composites including Kevlar, glass, quartz, ceramic, mineral, carbon, metallic, graphite, or hybridizations of fibers formed by combining different types of fibers to gain characteristics not attainable with a single reinforcing fiber. Outer shell 36 further comprises a resin, preferably a polymer resin such as an epoxy or polyimide. The resin may be thermoset or thermoplastic.

Either or both inner wrap 32 and outer shell 36 may be formed by helical windings of fiber having a uniform wrap angle or a plurality of wrap angles. The windings may comprise helical wraps approaching 90° commonly known as "hoop wraps," helical wraps approaching zero degrees, and/or helical wraps having intermediate wrap angles. For example, circumferential hoop wraps may be initially applied to the inner liner 22 to improve burst strength of the multi-lobe barrel 20, followed by intermediate helical wraps applied over the hoop wraps. The angles of the helical wraps may be guided by engineering analysis. Other wrap angles may be used alone or in combination with circumferential hoops, for example, to buffer or function as an intermediary layer to accommodate any difference in the coefficients of thermal expansion between inner liner 22 and reinforcement inserts 30.

Figure 7:
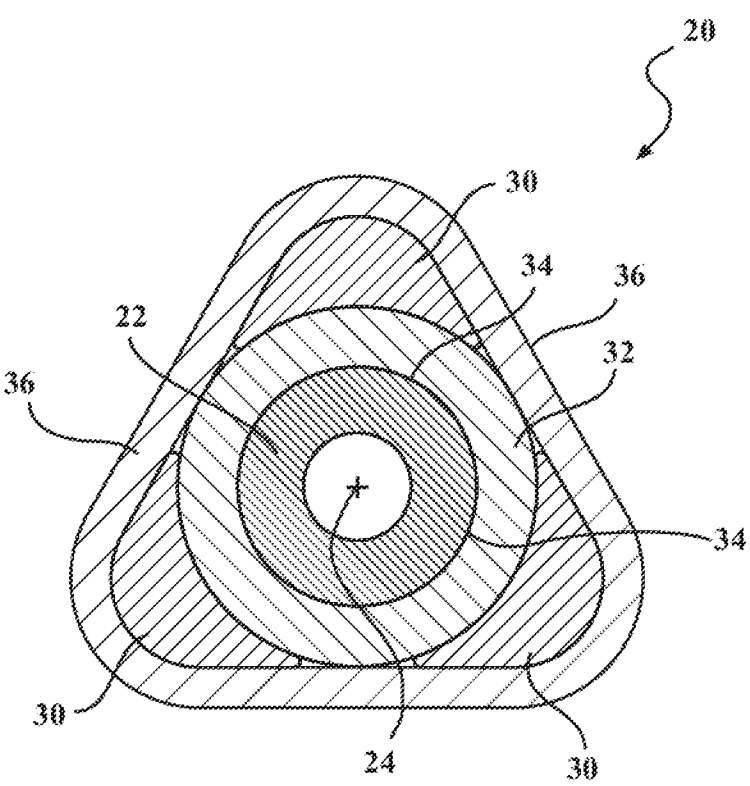
FIG. 7 is a transverse section near the middle of the composite barrel shown in FIG. 3.

FIGS. 4 and 5 respectively show a side view and longitudinal section of the multi-lobe barrel of FIG. 3. Turning first to FIG. 7 which depicts a transverse section of the embodiment near the middle of the barrel, inner liner 22 is generally cylindrical and defines axial bore 24. Inner liner 22 is surrounded by inner wrap 32. Inner wrap 32 may be a PMC in any of the variations described above concerning outer shell 36. Inner wrap 32 surrounds and is in direct contact with inner liner 22 at interface 34. Interface 34 is preferably substantially free of voids or gaps between inner liner 22 and inner wrap 32. It may be desirable to promote adhesion or to inhibit corrosion between the inner liner 22 and inner wrap 32 at interface 34. For purposes of this specification and the claims, "direct contact" means that the outer surface of inner liner 22 at interface 34 may include a surface treatment that is applied before inner wrap 32 is fabricated upon inner liner 22. For example, a PMC inner wrap 32 is in "direct contact" with a steel inner liner 22 at interface 34 even if the steel liner's surface is electroplated, anodized, or coated with a chemical compound or mixture, such as paint, resin, dielectric composite wrap, or other substance.

Returning to FIG. 7, the outer surface of inner wrap 32 is generally cylindrical, i.e. convex, corresponding to the generally cylindrical inner liner 22. A plurality of stiffening rods 30 are arranged equidistantly and circumferentially around inner wrap 32. The number of rods, approximately symmetrically arranged, would be from a minimum of two to any number. Outer shell 36 circumferentially encloses stiffening rods 30. Outer shell 36 and multi-lobe barrel 20 may take a final shape resembling the assembled sectional profiles of the plurality of circumferentially arranged stiffening rods 30, as shown in FIGS. 7 and 9-11. "Enclosing" as used herein means that outer shell 36 surrounds most or all of the longitudinal length of stiffening rods 30 and inner wrap 32. As shown in FIG. 4, portions of inner liner 22 are preferably exposed at breech end 14 and muzzle end 16, indicated as exposed inner liner 26. Even if multi-lobe barrel 20 had small portions of stiffening rods 30 and inner wrap 32 exposed (e.g. as the result of design or finishing process such as near breech end 14 and/or muzzle end 16), outer shell 36 would still "enclose" stiffening rods 30 and inner wrap 32 as used herein.

Figure 6:
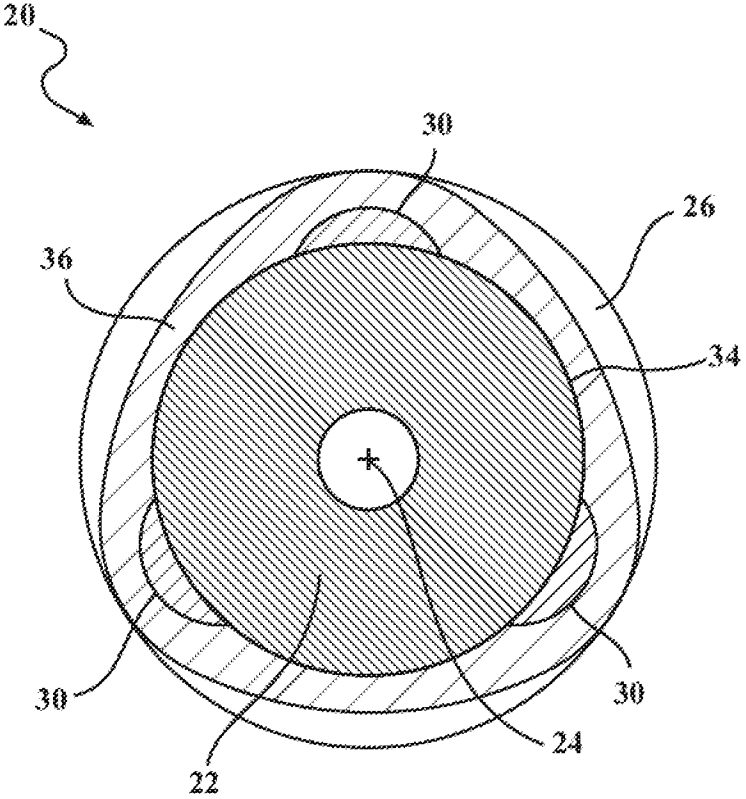
FIG. 6 is a transverse section near the breech end of the composite barrel shown in FIG. 3.

FIG. 6 is a transverse section of the same embodiment taken near the breech end of multi-lobe barrel 20 where the diameter of inner liner 22 is expanded in cone-like fashion. At this wider section of barrel 20 there is no inner wrap 32, so stiffening rods 30 lie adjacent to inner liner 22. As before, outer shell 36 circumferentially encloses stiffening rods 30. Of course, the geometry of inner liner 22 and the placement of inner wrap 32 and stiffening rods 30 may vary. For example inner wrap 32 could be present at the transverse section depicted in FIG. 6, or outer shell 36 could be fabricated to expose small portions of stiffening rods 30, or to expose portions of inner wrap 32, especially near the breech end 14 or muzzle end 16.

Further, the ends of stiffening rods 30 may be fabricated, e.g. cut or machined at an oblique angle, to mate with the conical slope of surface inner liner 22 as it transitions to muzzle portion 16 and breech portion 14. Alternatively, stiffening rods 30 may be placed so that they initially extend beyond the sloped conical shape at the muzzle and breech transition areas, and later undergo grinding or other process so that one or both ends of stiffening rods 30 are machined down to remove any unnecessary portion. As shown in FIGS. 5 and 6, the ends of stiffening rods 30 may be placed directly on the surface of the inner liner 22 as it conically slopes to the muzzle portion 16 and breech portion 14. Or stiffening rods 30 may be placed on inner wrap 32 if it extends to encompass enough of the muzzle and breech portions.

Stiffening rods 30 are comprised of a precured continuous fiber composite, i.e. a polymer matrix composite comprising fibers. Stiffening rods 30 may comprise fibers of carbon, glass, Kevlar, quartz, ceramic, or mineral. Intermediate modulus or high modulus carbon fiber rods perform well and are relatively inexpensive to purchase or fabricate. In one embodiment, stiffening rods 30 are pultruded and pre-cured carbon fiber rods, preferably with fibers oriented substantially longitudinally at ±0°. Pre-cured stiffening rod 30 is preferably both hard and stiff, thereby resisting distortion when the partially completed assembly is helically wound with outer shell 36. Stiffening rods 30 may be pultruded by drawing continuous fibers from a spool, which may be wetted with a matrix material such as a thermoset epoxy resin. The wetted fibers may then be pulled through a heated die, which die determines the shape of the profile. Polymerization of the resin takes place in the die, forming a rigid profile with sectional dimensions corresponding to that of the die and a length that is theoretically endless, but in practice cut to any desired length.

Pultrusion allows one to create a wide variety of sectional profiles for stiffening rods 30. FIG. 7 shows stiffening rods 30 as having a roughly triangular profile, with a concave interior surface (i.e. the surface closest to axial bore 24) to match the convex curvature of inner wrap 32. In the embodiment shown, stiffening rods 30 have an exterior surface (i.e., the surface further away from axial bore 24) comprising two generally planar sides not quite intersecting. In other words, in the embodiment shown in FIGS. 3-7, stiffening rod 30's profile is roughly a triangle having a concave interior side and an exterior side comprising two generally planar sides connected at the top by an arc. This embodiment of multi-lobe barrel 20 has three roughly triangular stiffening rods sandwiched between inner wrap 32 and the outer shell 36, ultimately forming a reinforced tri-lobe composite barrel 20.

Figure 9:
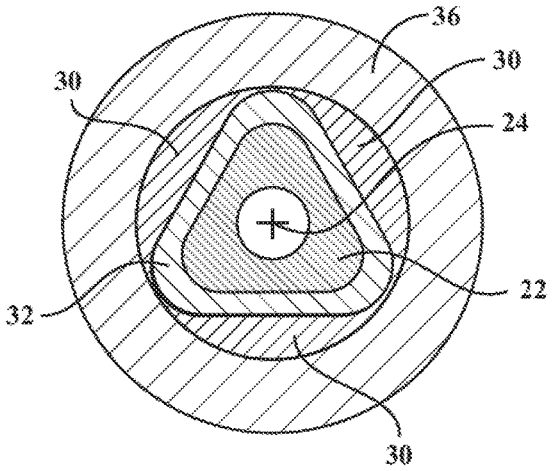
FIG. 9 is a middle transverse section of another embodiment of a multi-lobe composite barrel.

It will be appreciated that the sectional profile of stiffening rod 30 may be varied to modify its profile and/or the curvature of its interior surface. FIG. 9 is a transverse section of another embodiment of multi-lobe barrel 20 near the middle of the barrel, showing inner liner 22 having a triangular profile instead of a cylindrical profile. The triangular profile of inner liner 22 is surrounded by inner wrap 32, the wrap conforming to the roughly triangular profile. The interior surface of stiffening rods 30 is substantially flat to complement the flat surface of inner liner 22; the exterior surface of each of stiffening rods 30 are curved to form a circle segment, but stiffening rod 30's profile may be triangular or any other shape. In the embodiment shown, the exterior surface of the assembled three stiffening rods 30 form an approximate cylinder, which outer shell 36 encloses.

Figure 10:
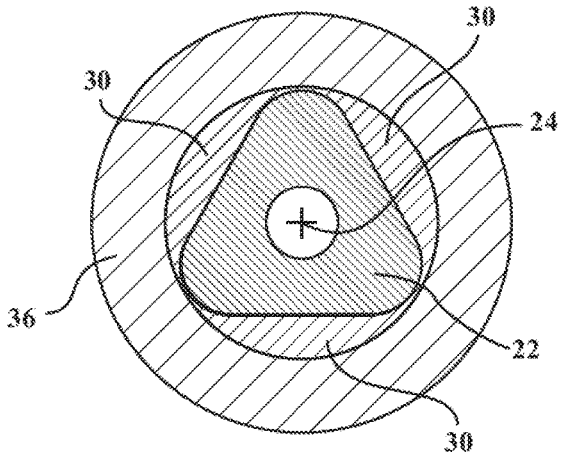
FIG. 10 is a middle transverse section of another embodiment of a multi-lobe composite barrel.

FIG. 10 is a transverse section taken near the middle of another embodiment of a multi-lobe barrel according to the invention. Like the previous embodiment, inner liner 22 is approximately triangular in shape and the profile of three stiffening rods is a circle segment. In this embodiment, however, stiffening rods 30 are disposed around and directly upon inner liner 22 with no intervening inner wrap. As before, outer shell 36 encloses stiffening rods 30 along all or substantially all of their longitudinal length.

Figure 11:
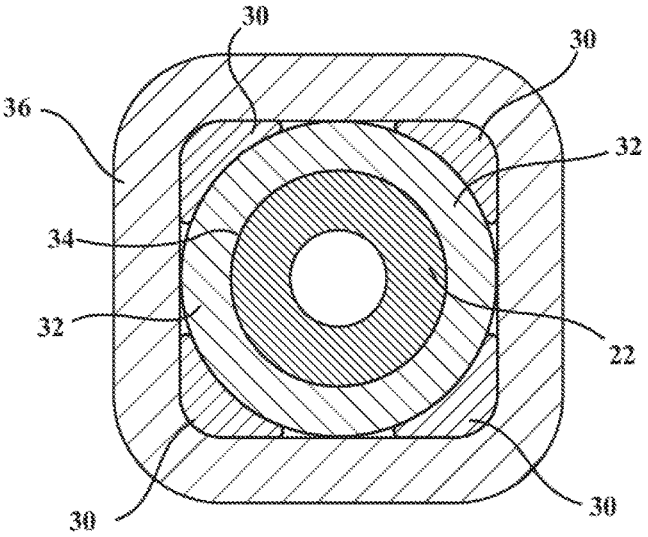
FIG. 11 is a middle transverse section of another embodiment of a multi-lobe composite barrel.

FIG. 11 is a transverse section taken near the middle of yet another embodiment of a multi-lobe barrel. Here, inner liner 22 is cylindrical and surrounded by inner wrap 32. In this embodiment four stiffening rods 30 are equidistantly disposed around the circumference of inner wrap 32. As before, outer shell 36 encloses stiffening rods 30 along all or substantially all of their longitudinal length. This embodiment produces a multi-lobe barrel 20 resembling an elongated square prism. In alternative embodiments (not shown) two or any greater number of stiffening rods 30 could be employed. The shape of muzzle end 16 may be varied to correspond with the number of the stiffening rods 30 (e.g. pentagon, hexagon, etc.). In a preferred embodiment of multi-lobe barrel 20, three stiffening rods 30 are circumferentially and equidistantly disposed on the saddle area of inner liner 22 so that the outward appearance of the multi-lobe barrel 20 has a generally tri-lobe barrel shape.

Depending on the materials utilized, stiffening rods 30 may have a lower coefficient of thermal expansion in the axial direction than inner liner 22, inner wrap 32 and/or outer shell 36. It may therefore be desirable to install stiffening rods 30 onto inner wrap 32 (or onto inner liner 22) so that after curing of the composite helical wraps at elevated temperature, at moderate use temperatures the stiffening rods 30 are under axial compression. At higher operating temperatures when inner liner 22 (and possibly the composite portions of multi lobe barrel 20) axially expand, stiffening rods 30 are allowed to expand from their compressed state. Such compressive state in moderate temperatures may be effected by means known to those skilled in the art, such winding outer shell 36 around stiffening rods 30 to enclose them while inner wrap 32 and inner liner 22 are heated, e.g. above 200° F.

Figure 8:
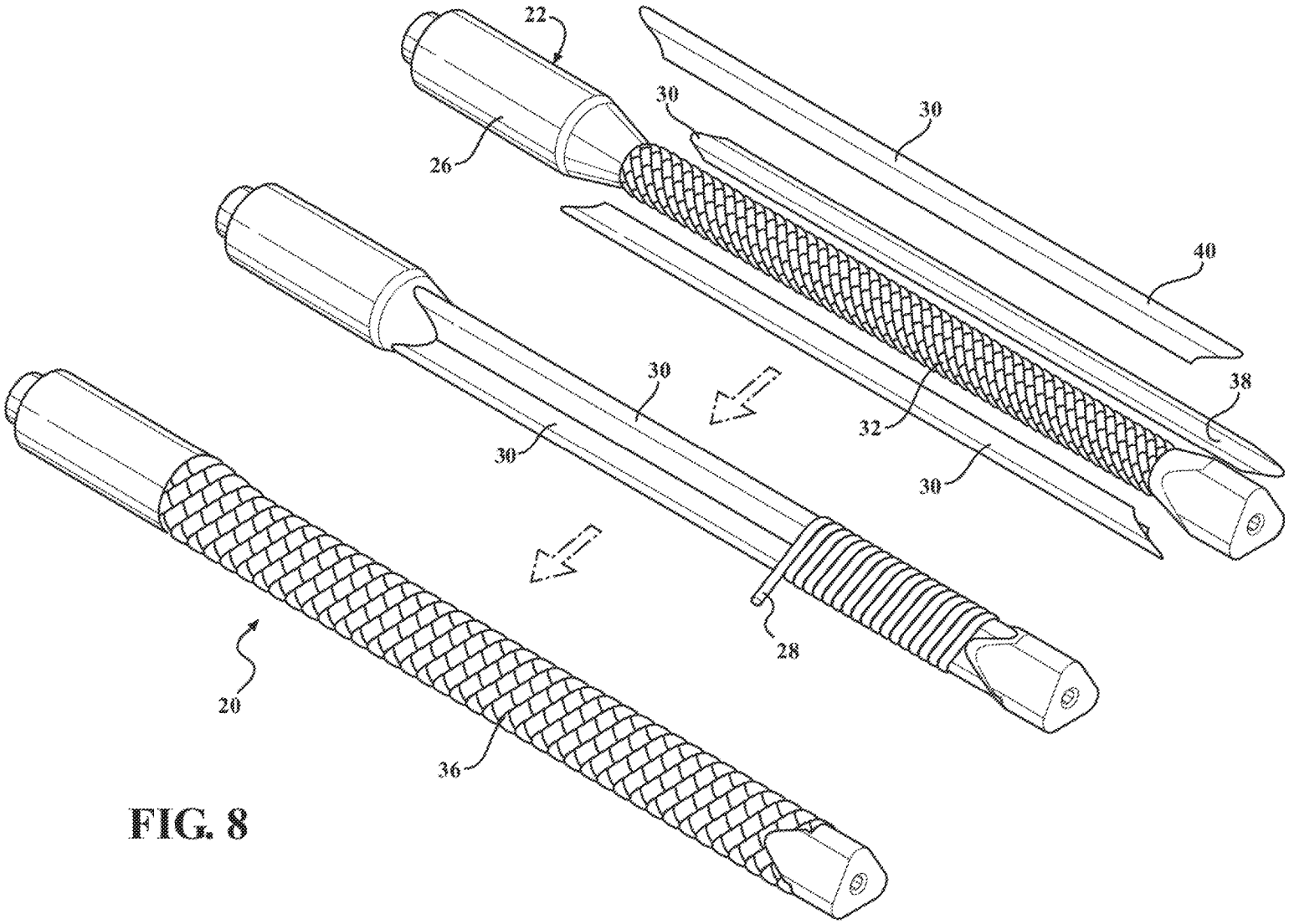
FIG. 8 represents some of the process steps to fabricate the composite barrel shown in FIG. 3.

FIG. 8 shows the general steps of fabricating a multi-lobe composite barrel according to the current invention. In one embodiment, manufacture of multi-lobe barrel 20 comprises the steps of:

1. wrapping a fiber tow around inner liner 22 to form inner wrap 32;
2. disposing pre-cured stiffening rods 30 in position on the still-wet inner wrap 32, held in correct orientation by natural adhesion or by alignment with jig, clamp, fixture, etc., the stiffening rods having an interior surface 38 and an exterior surface 40;
3. wrapping precured stiffening rods 30 in helical wraps to form outer shell 36, thereby bonding stiffening rods 30 and inner wrap 32 and outer shell 36 into one integrated assembly;
4. curing the assembly by subjecting to heat, pressure and/or vacuum;
5. finishing the surface of the cured assembly, e.g. by grinding, sanding, or milling, to produce a finished multi-lobe composite barrel 20 having a durable finish.

After each stiffening rod 30 is located in the proper position of inner wrap 30 (or in an alternate embodiment disposed directly on inner line 22), the outer shell 36 is applied over the stiffening rods 30. Outer shell 36 is securely bonded to stiffening rods 30, which are in turn securely bonded to inner wrap 32. The overwrap winding process of outer shell 36 may utilize un-cured resins that will serve to adhesively bond the reinforcement inserts 30 to the inner wrap 32 and outer shell 36, creating a unified structure. The angle of the helical wrap of outer shell 36 can be determined by an engineering analysis. (E.g., matching CTE, minimizing shear stresses, etc.), which may or may not be similar to the helical wrap angle(s) and depths of inner wrap 32. As discussed above, outer shell 36 can be structured in a plurality of radial regions, with each region having substantially the same winding angle.

Placing low-angle plies at or near the outer regions of multi-lobe barrel 20 may increase stiffness but compromise durability because they are more likely to delaminate or suffer inter-laminar failure, such as when rubbed against a rough surface. Placing higher angle plies in the outer regions of the multi-lobe barrel 20 may enhance durability. Preferably the outside surface of the outer composite wrap 36 provides a durable finish.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A barrel for directing the path of a dischargeable projectile, comprising:

a generally cylindrical steel inner liner defining an axial bore;

an inner wrap comprised of carbon fibers and resin, the carbon fibers helically wrapped around said inner liner;

an interface at the juncture of said inner liner and said inner wrap, said interface substantially free of voids;

a plurality of stiffening rods comprised of precured pultruded carbon fibers in resin, circumferentially and equidistantly disposed on and around said inner wrap, each of said stiffening rods having an interior surface and an exterior surface, wherein the interior surface is concave and complements the outer circumference of the inner wrap, and the exterior surface comprises two generally planar surfaces;

an outer shell comprising carbon fibers and resin, said outer shell circumferentially enclosing said stiffening rods.

2. The barrel of claim 1, wherein the number of said stiffening rods is three.

* * * * *